United States Patent [19]

Sherwood

[11] Patent Number: 4,699,144

[45] Date of Patent: Oct. 13, 1987

[54] MASTECTOMY BRASSIERE

[76] Inventor: Janice K. Sherwood, 2 Grove Isle Dr., Coconut Grove, Fla. 33133

[21] Appl. No.: 2,983

[22] Filed: Jan. 13, 1987

Related U.S. Application Data

[63] Continuation-in-part of Ser. No. 786,668, Oct. 11, 1985, Pat. No. 4,637,398.

[51] Int. Cl.[4] ..... A41C 3/10

[52] U.S. Cl. ..... 450/54

[58] Field of Search ..... 128/478, 479, 480, 482, 128/470, 473, 510, 462

[56] References Cited

U.S. PATENT DOCUMENTS

| | | | |
|---|---|---|---|
| 3,896,506 | 7/1975 | Hankins | 128/478 |
| 4,024,876 | 5/1977 | Penrock | 128/478 |
| 4,637,398 | 1/1987 | Sherwood | 128/478 |

*Primary Examiner*—Doris L. Troutman
*Attorney, Agent, or Firm*—Jerome Bauer

[57] ABSTRACT

A mastectomy garment includes an underbra, a prosthetic breast pad, and an outerbra. The underbra has a supporting cup for the normal breast and a substantially flat band portion to fit to the chest of the removed breast, enabling a firm, flat-fitting garment over the remaining chest surface of the removed breast. The prosthesis or false breast pad is removably adhered to the outer surface of the flat, binding portion. The outerbra, such as a conventional off-the-shelf brassiere, that overlies and is secured to the underbra forming a composite unitary prosthetic brassiere with the prosthetic breast pad positioned therebetween and means for adjustment of the brassiere to the wearer and individual adjustment of the prosthetic breast pad.

14 Claims, 4 Drawing Figures

MASTECTOMY BRASSIERE

BACKGROUND OF THE INVENTION

This application is a Continuation-In-Part of application Ser. No. 786,668, filed Oct. 11, 1985, now U.S. Letters Pat. No. 4,637,398 issued on Jan. 20, 1987.

The present invention relates to a prosthetic brassiere garment and in particular to an improved prosthetic brassiere garment for use by a person having a mastectomy where one or both breasts have been removed or altered.

Many attempts have been made to enable the patient suffering from a mastectomy to overcome the mental and physical shock associated therewith by attempting to reconstruct her physical being by providing mastectomy brassieres constructed to provide the appearance of having a pair of complete natural breasts. It has been suggested to provide mastectomy brassieres which are capable of being stuffed with sanitary pads, absorbing cotton or rubber forms simulating one or both breasts. It has also been suggested to provide brassieres with built in pockets in which such filling material can be located. Plastic forms filled with liquid have also been recommended as have inflatable plastic balloons. Reference may be made to U.S. Pat. Nos. 2,637,851; 3,447,538; 3,489,153; 4,363,144; and 4,185,332 for examples of such attempts. These references being illustrative further of the problems involved in providing mastectomy prosthetic brassieres of only limited success in solving such problems. Other prosthetic brassieres are disclosed in U.S. Pat. Nos. 2,661,470, 4,261,366, and Swiss Pat. No. 479,290.

Current mastectomy prosthesis have been designed namely to provide pseudo-architecturally simulated breast structures. They are generally heavy, uncomfortable, and expensive, as well as cosmetically less than optimum. Another group of prosthesis currently available, make use of pre-molded or pre-shaped plastics and although not heavy or expensive, are similarly less than desirable for aesthetic purposes, since they are generally mass produced and shaped in conformity with standard figures, rather than being shaped to conform to that of the woman wearing the garment.

For all such classes of prosthesis, the ability to wear aesthetically pleasing outer garments is virtually impossible, and outer garments such as high fashion dress wear, lower cut necklines, or the like cannot be worn and have been unusable until the present invention.

In particular, all of the prosthesis known to date have a tendency to pull or fall away from the chest wall of the removed breast as the woman moves or changes position, especially when the woman bends or even leans slightly forward. Another problem of the prior art arises from the fact that the breast prosthesis the woman wears often extends visually beyond the edges or border of the brassiere thereby revealing that the wearer has experienced disfiguringmastectomy surgery.

Still another problem existing with the current or prior known prosthesis is the fact that because of the expense incurred in constructing such prosthetic brassieres, they are not readily adaptable to changing brassiere styles, and the woman having had a mastectomy has relatively little choice in the form of the brassiere she can wear. This is particularly irksome to women who before having had the mastectomy have been accumstomed to having virtual infinite choice in updated designer brassiere styles and shapes, so as to go along with both her mood as well as the type of outer garment being worn.

It is an object of the present invention to overcome the problems heretofore mentioned and to provide a prosthesis which will be able to provide the woman with a large range of up to date brassiere shapes and styles. It is a further object of the present invention to provide a mastectomy prosthesis which fits both comfortably, accurately and will not shift in position or part or fall away from the chest wall to reveal the fact that the wearer has suffered the embarrassing removal of one or more breasts.

The foregoing objects and advantages together with numerous others will be apparent from the foregoing disclosure.

SUMMARY OF THE INVENTION

According to the present invention, a mastectomy brassiere garment is provided comprising in combination an inner or underbra, a prosthetic breast pad, and an outerbra. The underbra is of lightweight garment foundation material having a receiving and supporting cup for the normal breast, should one remain, and a substantially flat band portion for close fit against the chest wall of the removed breast so as to obviate any visual separation between the same and the chest of the wearer. The prosthesis breast pad itself is formed in the desired shape of a substantial mirror image to the remaining breast and is removably positioned between the underbra and outerbra at the flat band portion of the underbra. The outerbra may be a conventional off-the-shelf brassiere of any modern, up to date designer style and/or fashion that the wearer wishes. The outerbra is then placed over the underbra, with its natural breast receiving and supporting cups overlying respective any breast receiving and supporting cup of the underbra and respective flat portion of the underbra. The underbra and outerbra may be sewn or otherwise secured together to form a composite brassiere of unitary, singular construction with openings beneath the wearer's arms and in the areas of means for adjustment of the brassiere to the wearer and of the prosthetic breast pad. The ability to select a modern off-the-shelf bra, no longer limits or restricts the wearer to the use of stereotyped surgically appearing bras of one matronly appearing style.

By providing an underbra which conforms accurately and surely to the surface of the chest, at the point where the breast has been removed, and by placing the prosthesis and the outer brassiere thereover, the unitary garment prosthesis of the present invention maintains contact with the chest wall thereby obviating telltale separation therefrom no matter what position the woman assumes or movements that she performs.

By providing the underbra, the same can be more easily fit to the wearer to support the proper positioning of the prosthetic breast pad to and against the chest of the removed breast. Similarly, by removing the decorative function of the outerbra from that of the prosthesis and the inner fitting underbra garment, the user is not limited to an outerbra of any one style, shape or appearance. By combining the two (innerbra and outerbra) into a single, unitary brassiere structure only a single shoulder strap for each shoulder, and a single rear or back torso encompassing strap is required.

Full details of the present invention are set forth in the following description of the preferred embodiment and are illustrated in the accompanying drawings.

DESCRIPTION OF THE INVENTION

Figure 1:
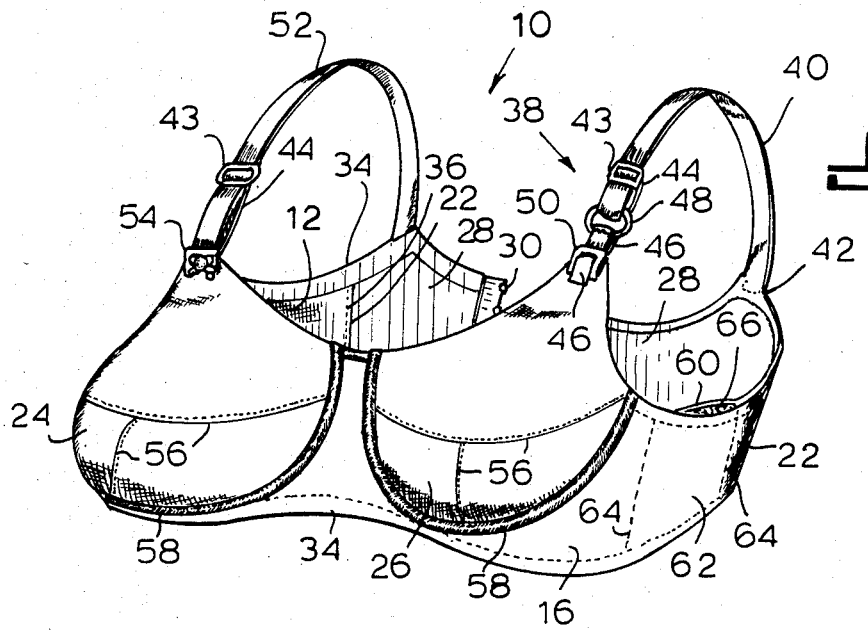
FIG. 1 is a front perspective view showing the underbra and outerbra forming the composite prosthetic brassiere according to the teaching of the present invention.

The composite prosthetic brassiere of the present invention is generally identified by the numeral 10 and comprises three basic components, namely, a base garment or underbra 12, a prosthetic breast simulating pad 14 and a decorative outerbra 16.

Specifically, the base garment or underbra 12, although appearing to conform closely in most respects to a regular brassiere, i.e. having right and left chest portions 18 and 20, and side or underarm and rearwardly encompassing side band portions or panels 22. The rearward extent of the side panels 22 is less than sufficient to fully encompass and fully enclose the torso of the wearer, however, they do extend aloang the side of the wearer to enable the same to cooperate with the corresponding sides of the outerbra to form pockets as will be explained.

As in a conventional brassiere the underbra 12 is preferably made of slightly expandable or resilient material, such as Spandex, nylon or the like so that when placed on the patient's torso will have a fully conforming fit as will be explained in greater detail later. The underbra 12, as shown in the Figures is made for a patient having only one breast removed, and therefore for illustration the right chest section 18 is shown completely formed with a natural breast receiving and supporting cup while the left chest section 20 is substantially flat. Should a garment be required for a patient having both breasts removed, then the illustrated cup, here the right section would appear identical to the flat or left chest section 20. Although the breast cup 18 is fully formed for a breast, the innerbra 12 is not specifically intended to provide a breast uplift support all by itself.

Figure 2:
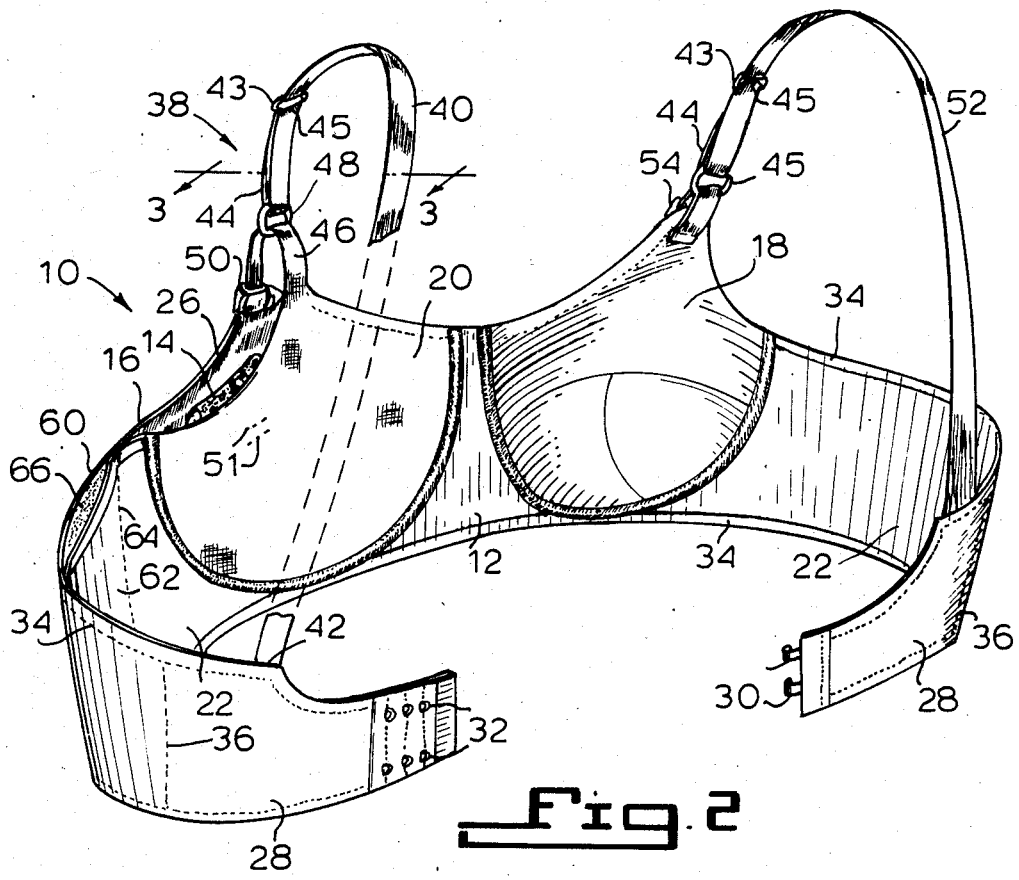
FIG. 2 is a rear elevational view with a portion thereof cut away to provide a fuller illustration of the details.

The base underbra 12 is formed to the contours of the torso of the patient. In sizing the underbra 12 the flat portion 20 covering the flat chest portion from which the breast has been removed, is designed in size, so as to lie fitting essentially flat in engagement against the chest wall as described and as seen in FIG. 2 of my co-pending patent application. The flat portion 20 may be made of a material that more readily absorbs moisture and feels more comfortable when held snug against the skin for long periods. Cotton has been found to be preferred although other materials may also be used.

The outerbra 16 is preferably an attractive decorative conventional commercially available brassiere since its purpose is indeed to be decorative, modernly attractive and cosmetic. Its purpose is also to provide a functional uplift and foundation support for the remaining and full breast of the wearer, as well as to provide the architectural support for the prosthetic or pseudo-breast pad 14 positioned between it and the underbra 12. Since, in fact, this is the specific function of the commercially available brasssiere 16, they need be manufactured no differently than those presently manufactured and can be in any of the current or future available models.

Being of substantial conventional construction the outerbra 16 is provided with a pair of right and left breast receiving and supporting cups 24 and 26 respectively, and oppositely directed and rearwardly extending side panels or band portions 28 that usually encompass and enclose the torso of the wearer by engagement at the hooks and fastener loops 30 and 32. The inner bra 12 and the outerbra 16 are secured together to form the unitary composite prosthetic brassiere 10 by sewing the same along their peripheral edges 34. Inasmuch as the side band portions or panels 22 of the underbra 12 are shorter than the corresponding side band panels or portions 28 of the outerbra 16, the ends of the portions 22 may be closed and secured to the respective portions 28 by vertical stitching 36 as an seen in FIGS. 1 and 2.

When so secured together to form the unitary composite brassiere 10, the right cup 24 will overlie its respective cup 18 of the underbra while the left cup 26 will overlie its respective flat portion 20 so that the two brassieres 12 and 16 effectively become a single composite brassiere 10 bound together at their peripheral edges 34. During the peripheral securement the overlying cup 26 and the underlying portion 20 are left free of stitching and securement and are therefore separated at their tops one from the other, in the area under the arm of the wearer and in the area of the adjustment means generally identified by the numeral 38.

Referring to the left cup 26 and the chest portion 20 it will be seen that the adjustment means 38 comprises a shoulder strap 40 of substantially conventional construction for a brassiere in that its rear end or back is securely joined with its respective band portion 28 as at 42. The strap 40 is connected at its other front end 45 to a central bar of a slide adjustment buckle 43 to form a loop 44 in the strap. As the buckle 43 is slid up and down along the length of the strap 40, the length of the strap is increased or decreased or shortened. This enables the adjustment of the composite prosthetic brassiere 10 as a whole to the upper torso of the wearer to enable the proper positioning of the breast cups 24 and 26.

Included as an integral part of the adjustment means 38 is a further means to precisely and individually adjust the position of the prosthetic breast simulating pad 14 positioned in the cup 26 and between such cup and the chest portion 20. The prosthetic breast pad individual adjustment means comprises a strap 46 that extends upward from the top portion of the panel 20 to extend through a connecting loop 48 retained in the loop 44 of the strap 40. The free end of the strap 46 then extends through a clasp or buckle 50 of any conventional construction which forms no part of the present invention that permits sliding movement of the strap 46 therethrough and locks the same in any selected position of adjustment. Inasmuch as the clasp or buckle 50 forms no part of the present invention, its specific details are not shown in the drawings. However, the buckle 50 is commonly used for lengthwise adjustment of lingerie straps.

The prosthetic breast simulating pad 14 is preferably molded foam plastic sponge or the like and may be constructed in the manner as taught in my co-pending patent application to simulate and match as closely as possible to the natural breast. The breast pad 14 is inserted into position between the cup 26 and the flat chest portion 20. Once it is selectively located between the underbra and the outerbra to correctly simulate the natural remaining breast, the opening originally left at the top between the chest portion 20 and the overlying cup 26 is then sewn closed or closed in any other convenient and attractive manner. The finite individual adjustment of the prosthetic brast pad 14 relative to the chest of the wearer is accomplished by initial adjustment of the shoulder strap 40 and then by the selective adjustment of the additional individual adjustment strap 46.

Figure 3:
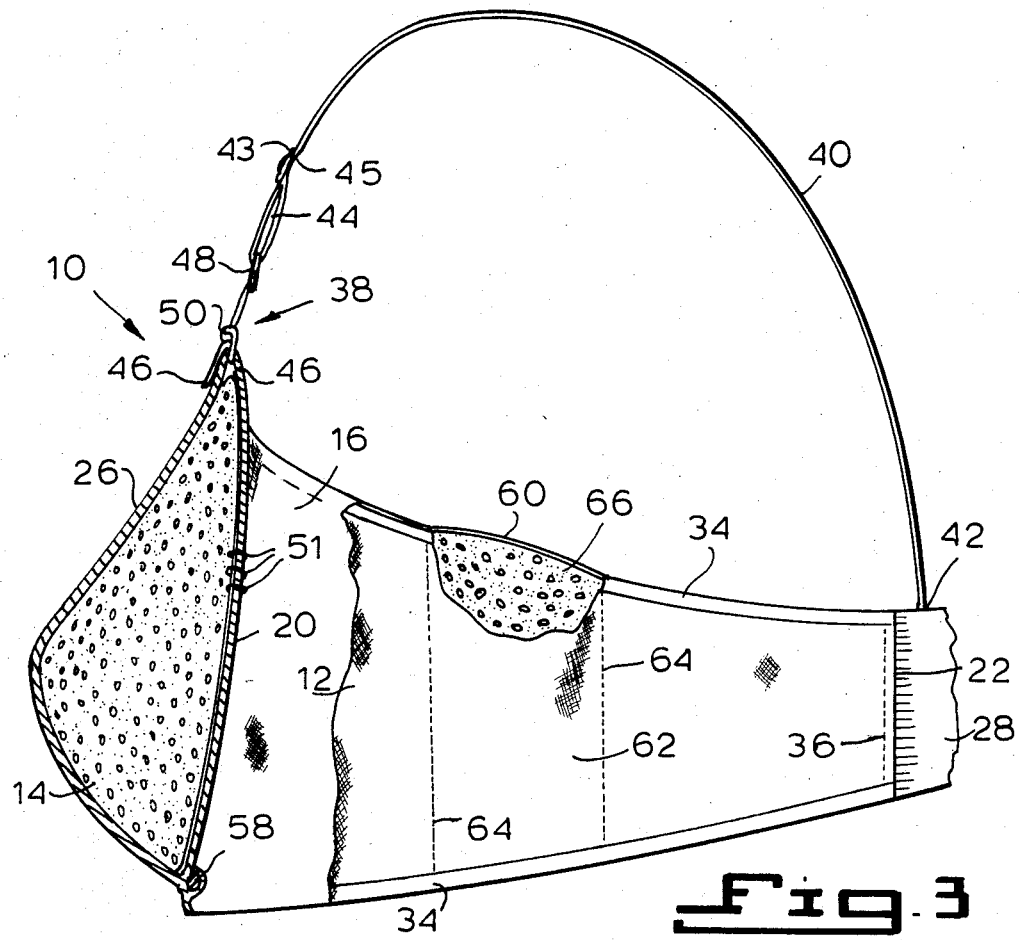
FIG. 3 is a cross-section of FIG. 2 taken substantially in the direction of lines 3—3 and with a portion thereof broken away to reveal details of side panel pockets.
Figure 4:
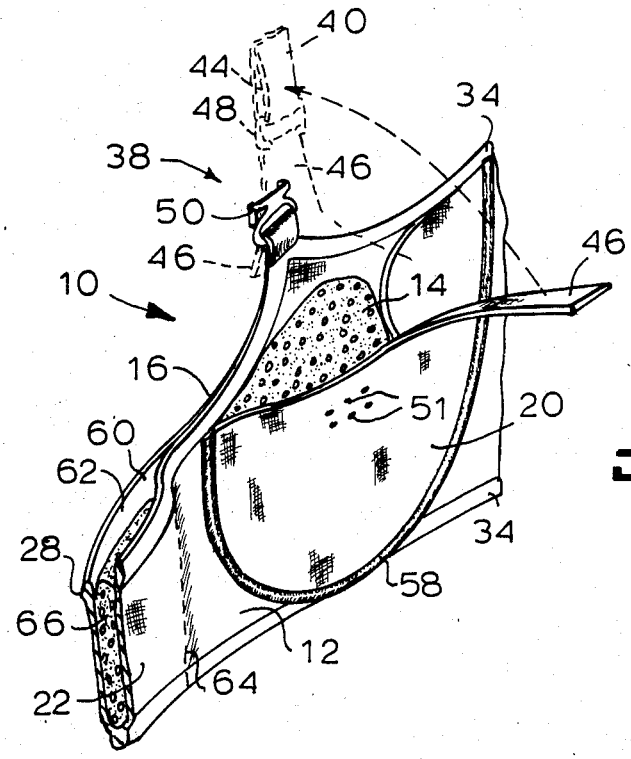
FIG. 4 is a partial perspective view of the means enabling individual adjustment of the prosthetic breast pad positioned between the underbra and outerbra.

In practice it has been found that the breast pad 14 will retain its adjusted position even during prolonged periods of use and also discontinuous periods of use if it is affixed to the facing surface of the panel 20. As described in my co-pending application, various forms of affixation may be used. It has been found that a simple basting stitch 51 as seen in FIG. 3 is adequate for such purpose. Thus, when the pad 14 is affixed to the panel 20 the operation of the individual adjusting strap 46 will adjust the position of the same relative to the outerbra 16 and to the chest of the wearer. When the pad 14 is affixed to the inner surface of the cup 26, adjustment of the individual adjustment strap 46 will adjust the position of the pad 14 relative to the panel 20 and also relative to the chest of the wearer to achieve the same effect.

It will be noted that the description of the double adjustment means 38 was confined to that of the prosthetic breast pad 14 only because the same finite and selective adjustment is not required for the cup 24 for the natural breast. For that reason, the strap 52 is shown connected directly with a false clasp or buckle 54 having the same structural details and appearance as the adjustment clasp or buckle 50 used for individual and finite selective adjustment of the prosthetic breast pad 14. Thus, the viewer cannot readily discern any difference between the adjustment means for the natural breast cup and that used for the prosthetic breast pad 14. The breast cups 24 and 26 may have the same outward appearance with breast shaping and supporting darts 56 and fabric covering uplift wire supports 58. However, should it be desired that the natural breast also have the finite adjustment that the prosthetic breast pad 14 is supplied with in the present invention, then the same structure as used for adjustment of the breast pad 14 and as described above may also be used for that of the natural breast cup 24.

Mastectomy surgery often requires the removal of nodes and tissue that leaves disfiguring hollows and depressions or cavities in the side of the body adjacent to the removed breast. In the past, the application to the torso of a mastectomy brassier merely accentuates such disfigurements by the brassier fitting snugly within the hollows or cavities and thereby displaying the disfigurements. During the joining of the underbra and the outerbra together to form the singular composite prosthetic brassiere 10, portion 60 at the top periphery of the two brassieres is left unsecured to form an entranceway to one or more vertically extending pockets 62 that are formed by vertically disposed stitchings 64 that secure together the side panel band portions 22 and 28.

When the composite brassiere is custom fit to the wearer, selected amounts of prosthetic material 66 of the same or different characteristics as that of the prosthetic breast pad 14 may be inserted into the pocket or pockets 62 to fill out the contour of the band portion 28 to hide any deformity that may exist therebeneath. Thereafter, the entrance 60 may be stitched or otherwise secured closed to enclose the material therein. The same is also for the enclosure of the prosthetic breast pad 14 between the underbra flat portion 20 and the cup 26 of the outerbra 16. That is to say, after the prosthetic breast pad is properly positioned between the inner and outer bras, the opening left at the top thereof in the area beneath the arm of the wearer and in the area of the adjustment means 38 may now be stitched or otherwise secured closed to enclose the breast prosthetic pad therewithin. Adjustment of the band portions 28 and their securement about the torso properly and accurately retains the pockets 62 over the disfiguring hollows or cavities that the wearer may have and retains the prosthetic material 66 in place therein.

Various modificiations and changes have been suggested, others will be apparent to those skilled in the art. It is intended, therefore, that the present disclosure be taken as illustrative of the invention and not limiting its scope.

What is claimed is:

1. A singular composite prosthetic brassiere garment compensating for the loss of a woman's breast consisting of the the combination of an underbra, a breast prosthesis and an outerbra, with said breast prosthesis between and affixed to one of said underbra or outerbra one of the underbra and outerbra having a band portion to enclose the torso, said underbra having a breast supporting cup for supporting the natural breast of the wearer when the wearer has a remaining breast, and a flat portion or portions fitting against the chest wall from which one or both breasts have been removed, said outerbra comprising a substantially conventional brassiere having a pair of natural breast supporting cups overlying the natural breast supporting cup or flat portions of said underbra, first adjustment means to adjust said singular composite brassiere as a whole to the wearer and including individual adjustment means connected with said flat portion and said overlying natural breast supporting cup to adjust the same relative to each other independenly of said first adjustment means and to adjust said prosthetic breast relative to the chest wall of the wearer from which the natural breast has been removed.

2. A singular composite prosthetic brassiere as in claim 1, said band portion having pockets along the sides of the torso for the receipt of prosthetic material therein to fill hollow areas of the torso thereat.

3. A singular composite prosthetic brassiere as in claim 2, said substantially conventional outerbra having said torso enclosing band portion.

4. A singular composite prosthetic brassiere as in claim 3, said underbra having partial side encircling portions underlying respective portions of said torso encircling portion of said outerbra to form said pockets therebetween.

5. A singular composite prosthetic brassiere as in claim 1, said flat portion or portions being formed of a material different from that of the remainder of said underbra.

6. A singular composite prosthetic brassiere as in claim 1, said underbra and outerbra being secured together to form said singular composite prosthetic brassiere with an opening therebetween in the area of said adjustment means for positioning said prosthetic breast relative to the outer surface of said flat portion of said underbra.

7. A singular composite prosthetic brassiere as in claim 1, said prosthetic breast being affixed to one of said flat portion and its respective supporting cup for selective adjustment of said prosthetic breast relative to the other.

8. A composite prosthetic brassiere for a woman having one or more breasts removed from her body comprising inner and outer brassieres, said inner brassiere having at least one or more substantially flat portions to cover and to lie in close fit with and against the torso of the wearer and the chest wall from which one or both breasts were removed and having a natural breast cup receiving and supporting a remaining breast, said outer brassiere having a pair of natural breast receiving and supporting cups and back encompassing bands to retain said natural breast cups in close fit against the wearer and with each of said natural breast cups overlying the substantially flat portion or portions and natural breast cup of said inner brassiere, a prosthetic breast pad or pads simulating the contour of the removed breast and positioned between said substantially flat band portion or portions of said inner brassiere and said natural breast cup of said outer brassiere to be held in close fit against the chest wall of the removed breast to appear as the natural breast of the wearer, and first adjustable means to adjust said composite prosthetic brassiere relative to the wearer and including second means to individually adjust said substantially flat portion or portions and respective overlying cup or cups relative to each other and said respective prosthetic pad or pads relative to the respective chests of the wearer.

9. A composite prosthetic brassiere as in claim 8, said inner and outer brassieres being secured together to form the composite brassiere as a unitary brassiere.

10. A composite prosthetic brassiere as in claim 8, said unitary brassiere having an opening between said flat portion of said inner brassiere and said overlying breast cup of said outer brassiere in the area of said adjustable means to receive said prosthetic breast pad for positioning therebetween.

11. A prosthetic brassiere for a woman having one or more breasts removed comprising a conventional outerbra having two breast receiving and supporting cups overlying an innerbra having a substantially flat portion conforming to the chest portion from which a breast has been removed, and a breast prosthesis to simulate the natural removed breast and received in the respective breast cup of said outerbra and against said flat portion and fastened to one of said innerbra and outerbra, one of said bras having at least a band portion to enclose the torso of the wearer and extending about the sides and back of the wearer, the other of said bras having band portions extending partially about the torso, pockets formed along said band portions along the sides of the wearer, prosthetic padding insertable in said pockets to cause the pockets to fill and hide hollow areas of the torso of the wearer to prevent the outward appearance of telltale depressions in said prosthetic brassiere when the same is fitted to tne hollow areas of the torso, and adjustable strap means for adjusting the whole of said prosthetic brassiere to the wearer and including separate means to adjust said innerbra relative to said outerbra selectively to position said breast prosthesis relative to the chest of the wearer to conform to the position of the natural breast.

12. A prosthetic brassiere as in claim 11, said innerbra and outerbra secured together to form said prosthetic composite brassiere.

13. A prosthetic brassiere as in claim 12, said outerbra being a substantially conventional brassiere having said band portion, and said innerbra having band portions partially encircling the sides of the wearer secured to said outerbra to form said pockets therebetween.

14. A prosthetic brassiere as in claim 11, said adjustable strap means to selectively position said breast prosthesis including buckle means and a tab extending through said buckle means for adjustable movement relative thereto, one of said buckle means and tab being on and joined with a selected one of said flat portions of said underbra and said respective overlying breast supporting cup of said outerbra, and a strap connected with said buckle means and with one of said band portions and having buckle means thereon for adjustment of the length of said strap.

* * * * *